US005771612A

United States Patent [19]

Lynch

[11] Patent Number: 5,771,612

[45] Date of Patent: Jun. 30, 1998

[54] LOADER BUCKET SIFTING SYSTEM

[76] Inventor: Eddie T. Lynch, 104 Turner St., Bloomfield, N. Mex. 87413

[21] Appl. No.: 680,015

[22] Filed: Jul. 15, 1996

[51] Int. Cl.[6] ..... E02F 5/22

[52] U.S. Cl. ..... 37/142.5; 37/904; 37/403; 172/32; 172/40; 209/421

[58] Field of Search ..... 37/142.5, 904, 37/403, 408, 409, 410, 444, 445, 379; 414/722, 912; 171/63; 172/32, 40; 209/421

[56] References Cited

U.S. PATENT DOCUMENTS

| | | | |
|---|---|---|---|
| 3,072,257 | 1/1963 | Hockenberry | 37/403 X |
| 3,732,980 | 5/1973 | Evers et al. | 37/403 X |
| 4,805,703 | 2/1989 | Carlsson | 37/444 X |
| 5,311,684 | 5/1994 | Van Dalfsen | 37/403 X |
| 5,398,430 | 3/1995 | Scott et al. | 37/142.5 |
| 5,493,796 | 2/1996 | Ballew et al. | 37/142.5 |
| 5,528,844 | 6/1996 | Ellis | 37/403 |
| 5,564,885 | 10/1996 | Staben, Jr. | 37/403 X |
| 5,581,916 | 12/1996 | Hirose et al. | 37/904 X |
| 5,596,824 | 1/1997 | Scott et al. | 37/403 |

*Primary Examiner*—Terry Lee Melius
*Assistant Examiner*—Victor Batson

[57] ABSTRACT

A new loader bucket vibrational sifting system for separating rock and other abrasive material from dirt extracted from a trench for a pipe line, thereby allowing the user to fill in the trench after laying the pipe with the sifted dirt eliminating contact by rock or other abrasive material with the pipeline and, thereby, preclude rusting, corrosion, or like damage. The inventive device includes a sifting structure formed to pivotally enclose a conventional loader bucket, a vibrating means secured near the pivoting end of the sifting structure for vibrating the sifting structure, and a hydraulic releasing means pivotally secured at one end to the sifting structure and pivotally secured at the opposite end to the conventional loader bucket manipulating the sifting structure to allow rocks to be released.

6 Claims, 3 Drawing Sheets

LOADER BUCKET SIFTING SYSTEM

BACKGROUND OF THE INVENTION

1. Field of the Invention

The present invention relates to Loader Bucket Devices and more particularly pertains to a new loader bucket vibrational sifting system for separating rock and other abrasive material from dirt extracted from a trench for a pipe line, thereby allowing the user to fill in the trench after laying the pipe with the sifted dirt eliminating contact by rock or other abrasive material with the pipeline and, thereby, preclude rusting, corrosion, or like damage.

2. Description of the Prior Art

The use of Loader Bucket Devices is known in the prior art. More specifically, Loader Bucket Devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art Loader Bucket Devices include U.S. Pat. No. 4,698,925; U.S. Pat. No. 5,398,430; U.S. Design Pat. No. 332,271; U.S. Pat. No. 5,271,168; U.S. Pat. No. 4,517,755 and U.S. Pat. No. 4,303,507.

While these devices fulfill their respective, particular objectives and requirements, the aforementioned patents do not disclose a new loader bucket vibrational sifting system. The inventive device includes a sifting structure formed to pivotally enclose a conventional loader bucket, a vibrating means secured near the pivoting end of the sifting structure for vibrating the sifting structure, and a hydraulic releasing means pivotally secured at one end to the sifting structure and pivotally secured at the opposite end to the conventional loader bucket manipulating the sifting structure to allow rocks to be released.

In these respects, the loader bucket vibrational sifting system according to the present invention substantially departs from the conventional concepts and designs of the prior art, and in so doing provides an apparatus primarily developed for the purpose of separating rock and other abrasive material from dirt extracted from a trench for a pipe line, thereby allowing the user to fill in the trench after laying the pipe with the sifted dirt eliminating contact by rock or other abrasive material with the pipeline and, thereby, preclude rusting, corrosion, or like damage.

SUMMARY OF THE INVENTION

In view of the foregoing disadvantages inherent in the known types of Loader Bucket Devices now present in the prior art, the present invention provides a new loader bucket vibrational sifting system construction wherein the same can be utilized for separating rock and other abrasive material from dirt extracted from a trench for a pipe line, thereby allowing the user to fill in the trench after laying the pipe with the sifted dirt eliminating contact by rock or other abrasive material with the pipeline and, thereby, preclude rusting, corrosion, or like damage.

The general purpose of the present invention, which will be described subsequently in greater detail, is to provide a new loader bucket vibrational sifting system apparatus and method which has many of the advantages of the Loader Bucket Devices mentioned heretofore and many novel features that result in a new loader bucket vibrational sifting system which is not anticipated, rendered obvious, suggested, or even implied by any of the prior art Loader Bucket Devices, either alone or in any combination thereof.

To attain this, the present invention generally comprises a sifting structure formed to pivotally enclose a conventional loader bucket, a vibrating means secured near the pivoting end of the sifting structure for vibrating the sifting structure, and a hydraulic releasing means pivotally secured at one end to the sifting structure and pivotally secured at the opposite end to the conventional loader bucket manipulating the sifting structure to allow rocks to be released.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new loader bucket vibrational sifting system apparatus and method which has many of the advantages of the Loader Bucket Devices mentioned heretofore and many novel features that result in a new loader bucket vibrational sifting system which is not anticipated, rendered obvious, suggested, or even implied by any of the prior art Loader Bucket Devices, either alone or in any combination thereof.

It is another object of the present invention to provide a new loader bucket vibrational sifting system which may be easily and efficiently manufactured and marketed.

It is a further object of the present invention to provide a new loader bucket vibrational sifting system which is of a durable and reliable construction.

An even further object of the present invention is to provide a new loader bucket vibrational sifting system which is susceptible of a low cost of manufacture with regard to both materials and labor, and which accordingly is then susceptible of low prices of sale to the consuming public, thereby making such loader bucket vibrational sifting system economically available to the buying public.

Still yet another object of the present invention is to provide a new loader bucket vibrational sifting system which provides in the apparatuses and methods of the prior art some of the advantages thereof, while simultaneously overcoming some of the disadvantages normally associated therewith.

Still another object of the present invention is to provide a new loader bucket vibrational sifting system for separating rock and other abrasive material from dirt extracted from a trench for a pipe line, thereby allowing the user to fill in the trench after laying the pipe with the sifted dirt eliminating contact by rock or other abrasive material with the pipeline and, thereby, preclude rusting, corrosion, or like damage.

Yet another object of the present invention is to provide a new loader bucket vibrational sifting system which includes a sifting structure formed to pivotally enclose a conventional loader bucket, a vibrating means secured near the pivoting end of the sifting structure for vibrating the sifting structure, and a hydraulic releasing means pivotally secured at one end to the sifting structure and pivotally secured at the opposite end to the conventional loader bucket manipulating the sifting structure to allow rocks to be released.

Still yet another object of the present invention is to provide a new loader bucket vibrational sifting system that is adaptable to various sizes of back hoes or front-end loader buckets.

Even still another object of the present invention is to provide a new loader bucket vibrational sifting system that allows the user to use the same dirt that came out of the ditch for padding the pipeline instead of having to haul in select padding materials, thereby saving time and money for padding the pipeline.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
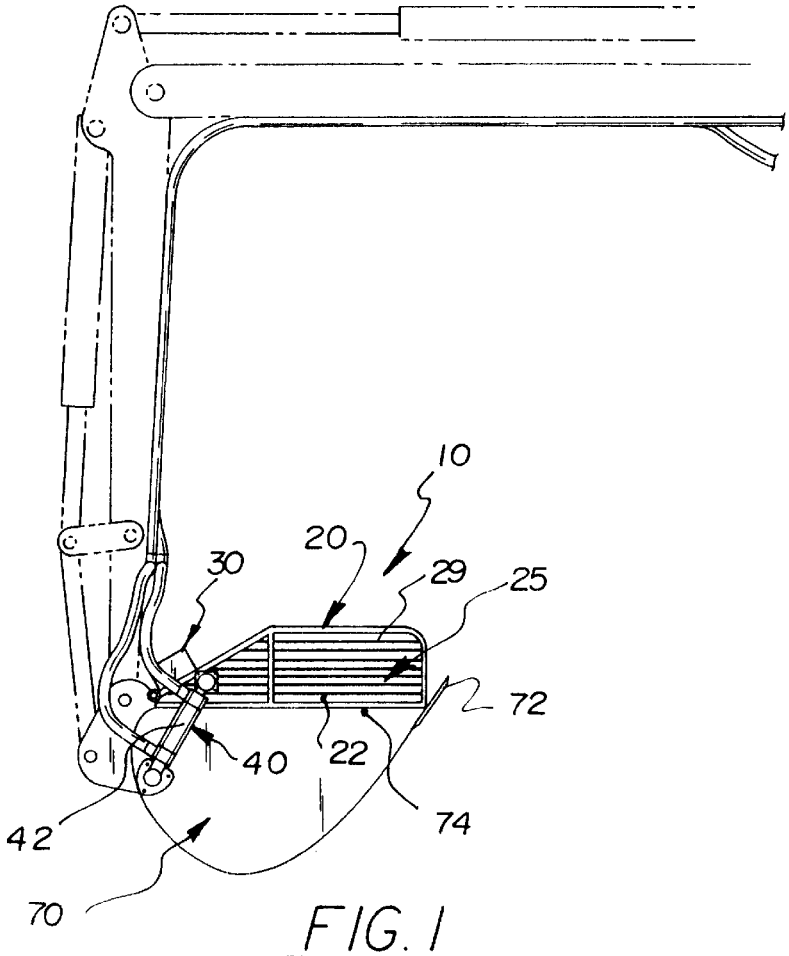
FIG. 1 is a right side view of a new loader bucket vibrational sifting system according to the present invention.

With reference now to the drawings, and in particular to FIGS. 1 through 6 thereof, a new loader bucket vibrational sifting system embodying the principles and concepts of the present invention and generally designated by the reference numeral 10 will be described.

More specifically, it will be noted that the loader bucket vibrational sifting system 10 comprises a sifting structure 20 pivotally secured to the rear portion of a conventional loader bucket 70 and formed to fit the shape of the conventional loader bucket 70, a hydraulic releasing means 40 pivotally secured to the sifting structure 20 at one end and pivotally secured to the conventional loader bucket 70 at the opposite end, and a vibrating means 30 secured to the lower rear portion of the sifting structure 20 for vibrating the sifting structure 20 allowing sifting of the loaded dirt.

Figure 2:
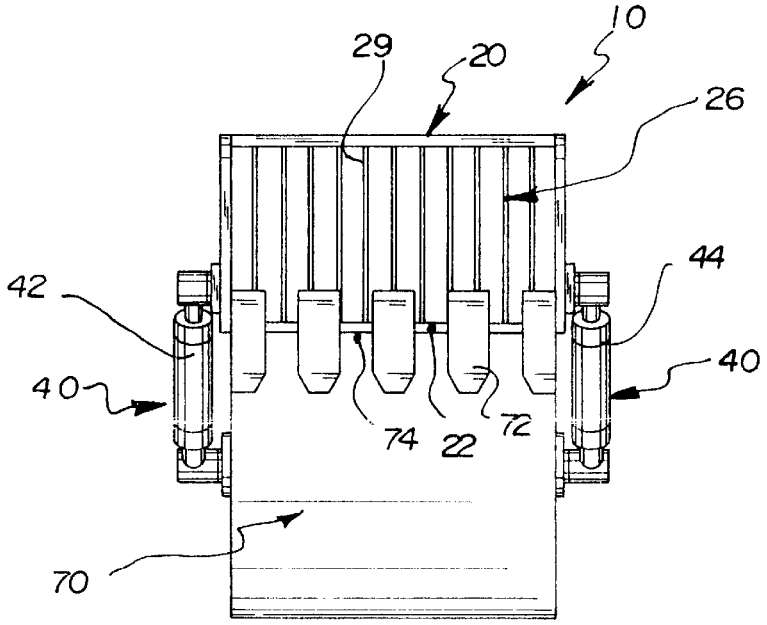
FIG. 2 is a front view of the present invention disclosing the hydraulic releasing means secured to the sifting structure and the conventional loader bucket.
Figure 3:
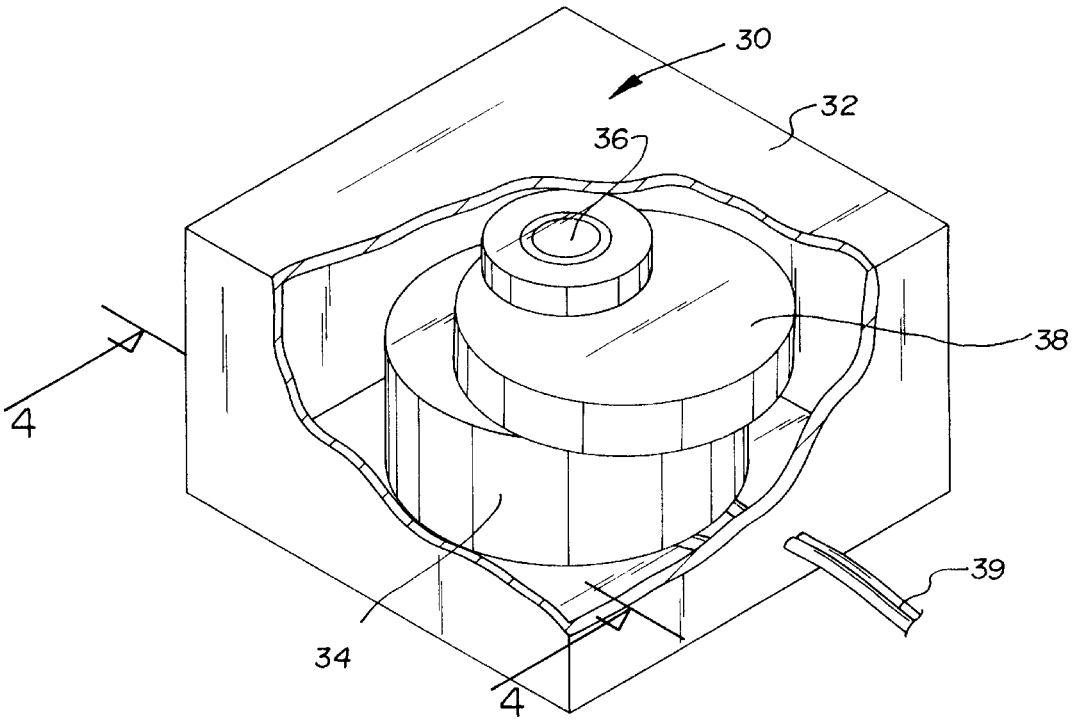
FIG. 3 is a cut away view of the vibrating means.
Figure 4:
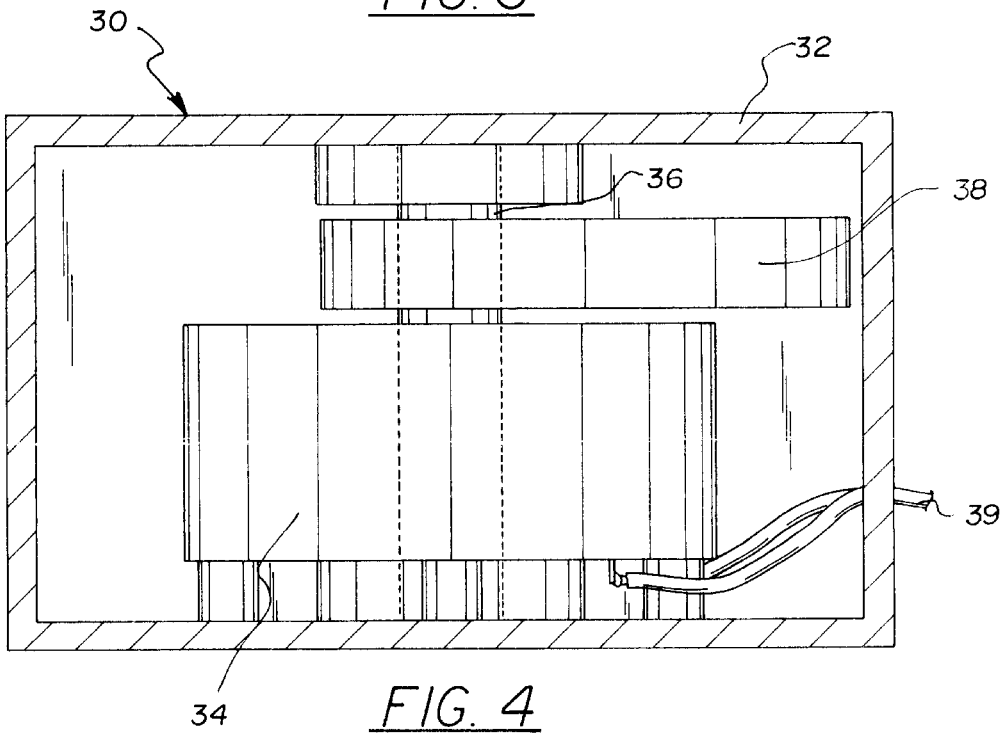
FIG. 4 is a cross sectional view taken along line 4—4 of FIG. 3 disclosing the hydraulic rotating motor rotatably securing the vibrating weight.
Figure 5:
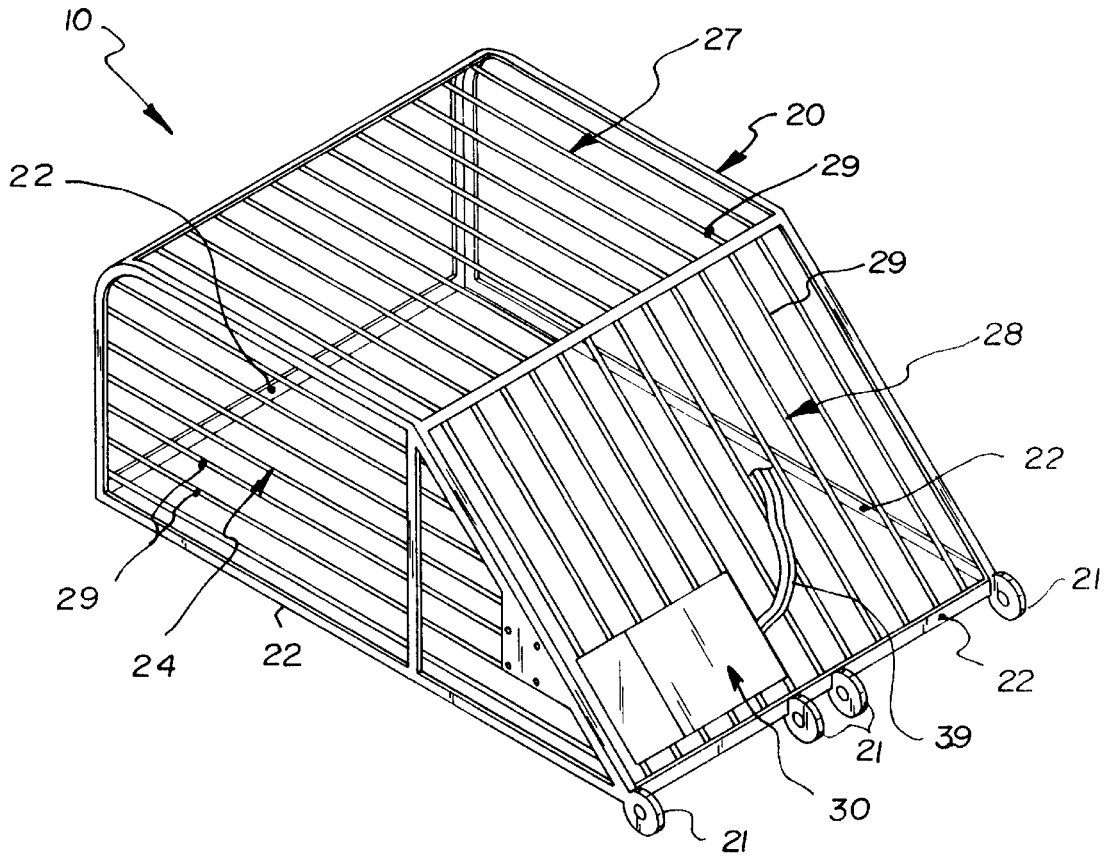
FIG. 5 is an upper left side perspective view of the present invention disclosing the vibrating means secured to the rear lower portion of the sifting structure.
Figure 6:
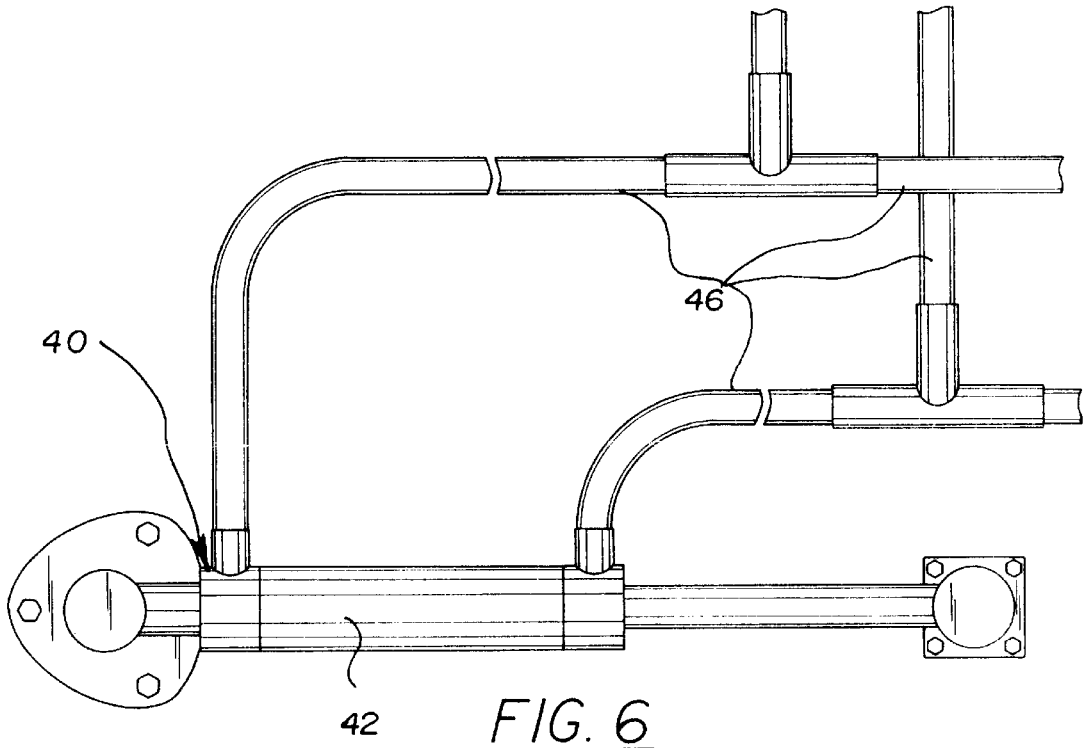
FIG. 6 is a magnified view of the right hydraulic cylinder fluidly connected to the first hydraulic hose.

As best illustrated in FIGS. 1–2 and 5, it can be shown that the sifting structure 20 includes an upper edge engaging support rim 22 formed to fit a loader bucket upper edge 74. A plurality of pivoting members 21 are secured to a shortened end of the upper edge engaging support rim 22. The pivoting members 21 rotatably engage the rear upper portion of the conventional loader bucket 70 opposite of a front cutting edge 72 of the conventional loader bucket 70 as best disclosed in FIG. 5 of the drawings. A left sifting side 24 is secured to the upper edge engaging support rim 22 opposite of the pivoting members 21 projecting along a substantial portion of an elongated side thereafter the upper edge of the left sifting side 24 slants towards the edge of the upper edge engaging support rim 22 securing the pivoting members 21, projecting orthogonally to the plane of said upper edge engaging support rim 22 as best disclosed in FIG. 5 of the drawings. A right sifting side 25 is secured to the upper edge engaging support rim 22 opposite of the pivoting members 21 projecting along a substantial portion of an elongated side opposite of the left sifting side 24 thereafter the upper edge of the right sifting side 25 slants towards the edge of the upper edge engaging support rim 22 securing the pivoting members 21, projecting orthogonally to the plane of said upper edge engaging support rim 22 as best shown in FIG. 1 of the drawings. A front sifting side 26 is secured to the upper edge engaging support rim 22 opposite of the pivoting members 21, adjacent and secured to the first and right sifting sides 24 and 25, and projecting orthogonally to the plane of said upper edge engaging support rim 22 as best disclosed in FIG. 2 of the drawings. A bottom sifting side 27 is secured to the front sifting side 26 opposite of the upper edge engaging support rim 22, and projects along the left sifting side 24 and the right sifting side 25 orthogonally and opposite of the upper edge engaging support rim 22 until said left and right sifting sides 24 and 25 begin to slant thereby forming a U-shaped structure with one end enclosed by the front sifting side 26 allowing a predetermined size of an object to pass through as best disclosed in FIG. 5 of the drawings. As shown in FIG. 5 of the drawings, a slanted sifting side 28 is secured to adjacent to the edge of the bottom sifting side 27 opposite of the front sifting side 26. The slanted sifting side 27 projects along the slanted portion of the left and right sifting sides 24 and 25 terminating at the edge of the upper edge engaging support rim 22 securing the pivoting members 21. The vibrating means 30 includes an encasement structure 32 secured to the slanted sifting side 28 near the pivoting members 21 as best shown in FIG. 5 of the drawings. A hydraulic rotating motor 34 is secured within the encasement structure 32 as shown in FIGS. 3 and 4 of the drawings. A second hydraulic hose 39 is fluidly connected to the hydraulic rotating motor 34 as best shown in FIG. 4 of the drawings. A vibrating weight 38 is secured off center to a rotating shaft 36 projecting from the hydraulic rotating motor 34 so as to cause vibration when the rotating shaft 36 is rotated which vibrates the entire sifting structure 20. As best disclosed in FIG. 1 of the drawings, the hydraulic releasing means 40 includes a right hydraulic cylinder 42 pivotally secured to the right sifting side 25 at one end and pivotally secured to the conventional loader bucket 70 at the opposite end. The right hydraulic cylinder 42 is fluidly connected to a first hydraulic hoses 46 allowing control of the opening and closing of the sifting structure 20. The hydraulic releasing means 40 further includes a left hydraulic cylinder 44 pivotally secured to the left sifting side 24 at one end and pivotally secured to the conventional loader bucket 70 at the opposite end. The left hydraulic cylinder 44 is fluidly connected to the first hydraulic hoses 46 allowing control of the opening and closing of the sifting structure 20 while acting in cooperation of with the right hydraulic cylinder 42. The sifting structure 20 is preferably constructed from a plurality of parallel sifting ribs 29 sized to allow a predetermined size object to pass through as best disclosed in FIG. 5 of the drawings. In an alternative embodiment, the sifting structure 20 is constructed from an unnumbered reticulated material sized to allow a predetermined size object pass through.

In use, the sifting structure 20 is rotated away from the conventional loader bucket 70 by the hydraulic releasing means 40. The conventional loader bucket 70 then penetrates the digging surface retaining a certain amount of dirt from the digging surface. The sifting structure 20 is then closed positioning the upper edge engaging support rim 22 juxtaposed to the loader bucket upper edge 74 thereby encasing the dirt. The user then tips the conventional loader bucket 70 so as to position the bottom sifting side 27 near and substantially parallel the ground. The hydraulic rotating motor 34 is thereafter engaged rotating the rotating shaft 36 which rotates the vibrating weight 38. The vibrating weight 38 produces vibrations which vibrate the sifting structure 20. The vibrating of the sifting structure 20 allows the smaller objects and dirt to sift through the plurality of sifting ribs 29 into a specified padding pile. The remaining objects which are too large to sift through are then released into a separate specified pile by opening the sifting structure 20 through the hydraulic releasing means 40 and tilting the conventional loader bucket 70. The specified pile containing the smaller objects and dirt may later be utilized for padding the pipeline after the pipe has been positioned within the trench.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A loader bucket sifting system comprising:

a sifting structure pivotally secured to the rear portion of a conventional loader bucket and formed to fit the shape of the conventional loader bucket;

the sifting structure including an upper edge engaging support rim formed to fit a loader bucket upper edge;

a plurality of pivoting members secured to a shortened end of the upper edge engaging support rim, where the pivoting members rotatably engage a rear upper portion of the conventional loader bucket opposite of a front cutting edge of the conventional loader bucket;

a left sifting side secured to the upper edge engaging support rim opposite of the pivoting members projecting along a substantial portion of an elongated side thereafter the upper edge of the left sifting side slants towards an edge of the upper edge engaging support rim securing the pivoting members, projecting orthogonally to a plane of said upper edge engaging support rim;

a right sifting side secured to the upper edge engaging support rim opposite of the pivoting members projecting along a substantial portion of an elongated side opposite of the left sifting side thereafter the upper edge of the right sifting side slants towards an edge of the upper edge engaging support rim securing the pivoting members, projecting orthogonally to the plane of said upper edge engaging support rim;

a front sifting side secured to the upper edge engaging support rim opposite of the pivoting members, adjacent and secured to the first and right sifting sides, and projecting orthogonally to the plane of said upper edge engaging support rim;

a bottom sifting side secured to the front sifting side opposite of the upper edge engaging support rim, and projecting along the left sifting side and the right sifting side orthogonally and opposite of the upper edge engaging support rim until said left and right sifting sides begin to slant thereby forming a U-shaped structure with one end enclosed by the front sifting side allowing a predetermined size of an object to pass through; and a slanted sifting side secured adjacent to the edge of the bottom sifting side opposite the front sifting side thereafter projecting along a slanted portion of the left and right sifting sides terminating at an edge of the upper edge engaging support rim securing the pivoting members:, a hydraulic releasing means pivotally secured to the sifting structure at one end and pivotally secured to the conventional loader bucket at the opposite end; and a vibrating means secured to a lower rear portion of the sifting structure for vibrating the sifting structure allowing sifting of the loaded dirt.

2. The loader bucket sifting system of claim 1, wherein the vibrating means includes:

an encasement structure secured to the slanted sifting side near the pivoting members;

a hydraulic rotating motor secured within the encasement structure;

a second hydraulic hose fluidly connected to the hydraulic rotating motor supplying fluid which rotates the hydraulic rotating motor; and a vibrating weight secured off center to a rotating shaft projecting from the hydraulic rotating motor so as to cause a vibration when the rotating shaft is rotated.

3. The loader bucket sifting system of claim 1, wherein the hydraulic releasing means includes a right hydraulic cylinder pivotally secured to the right sifting side at one end and pivotally secured to the conventional loader bucket at the opposite end, and fluidly connected to a first hydraulic hoses allowing control of the opening and closing of the sifting structure.

4. The loader bucket sifting system of claim 1, wherein the hydraulic releasing means further includes a left hydraulic cylinder pivotally secured to the left sifting side at one end and pivotally secured to the conventional loader bucket at the opposite end, and fluidly connected to the first hydraulic hoses allowing control of the opening and closing of the sifting structure.

5. The loader bucket sifting system of claim 1, wherein the sifting structure is constructed from a plurality of parallel sifting ribs sized to allow a predetermined size object to pass through.

6. The loader bucket sifting system of claim 1, wherein the sifting structure is constructed from a reticulated material sized to allow a predetermined size object to pass through.

* * * * *